United States Patent [19]

Lane et al.

[11] Patent Number: 4,487,990

[45] Date of Patent: Dec. 11, 1984

[54] SIMPLIFIED WATER-COOLED WELDING CABLE TERMINAL

[75] Inventors: Charles H. Lane, Birmingham, Mich.; James K. Whittington, Mitchell, Ind.

[73] Assignee: Essex Group, Inc., Fort Wayne, Ind.

[21] Appl. No.: 552,899

[22] Filed: Nov. 17, 1983

[51] Int. Cl.[3] ..... H01B 7/34

[52] U.S. Cl. ..... 174/15 WF; 174/19

[58] Field of Search ..... 174/15 WF, 19; 219/137.9

[56] References Cited

U.S. PATENT DOCUMENTS

| | | | |
|---|---|---|---|
| 2,906,807 | 9/1959 | Wreford et al. | 174/19 |
| 3,127,467 | 3/1964 | Toto | 174/15 WF |
| 3,333,044 | 7/1967 | Toto | 174/15 |
| 3,340,346 | 9/1967 | Toto | 174/15 |
| 3,456,064 | 7/1969 | Toto | 174/15 |
| 3,467,767 | 9/1969 | Toto | 174/113 |
| 3,601,520 | 8/1971 | Carasso | 174/15 |
| 3,801,724 | 4/1974 | Goodman | 174/15 WF |
| 3,808,350 | 4/1974 | Kluge et al. | 174/15 WP |
| 3,952,141 | 4/1976 | Huber | 174/15 WF X |
| 4,018,976 | 4/1977 | Grove | 174/19 |
| 4,198,111 | 4/1980 | Cappel | 339/112 |
| 4,199,653 | 4/1980 | Talley | 174/15 |
| 4,442,312 | 4/1984 | Oshkin et al. | 174/15 WF |

FOREIGN PATENT DOCUMENTS

| | | | |
|---|---|---|---|
| 654825 | 6/1963 | Italy | 174/15 WF |
| 958431 | 5/1964 | United Kingdom | 174/15 WF |

*Primary Examiner*—John F. Gonzales
*Assistant Examiner*—Morris H. Nimmo
*Attorney, Agent, or Firm*—Robert P. Hayter

[57] ABSTRACT

A dual polarity terminal for a water-cooled, kickless welding cable having a plurality of electrical conductors, each half terminal having one half of the electrical conductors fixedly crimped thereto in a single manufacturing step. A series of overlapping bore openings in the end face of each half terminal form a socket which is mechanically welded to the sidewall of the half terminal in a press. A particularly shaped lie leaves an axially-extending depression near the rear of the half terminal which acts as a water passageway. An insulating strip electrically isolates the two halves of the dual polarity terminal.

9 Claims, 2 Drawing Figures

FIG. 2

SIMPLIFIED WATER-COOLED WELDING CABLE TERMINAL

DESCRIPTION

1. Technical Field

This invention relates generally to resistance welding cables, and more particularly, to a simplified, multiconductor, kickless, resistance welding cable with a minimal number of parts in each terminal.

2. Background Art

Multiconductor resistance welding cables of the "kickless" type are generally well known in the art and are used to connect a welding gun to transformer which provides the low voltage electrical current for the resistance welding operations. The kickless cables have low reactance so that the extremely high currents involved in the welding process will not cause jerks, or cable movements which lead to early cable failure.

As is known, kickless welding cables normally have multiple stranded conductors, half of which are classified as positive conductors, while the other half are negative conductors. A core insulator extends along the length of the welding cable for electrically isolating the adjacent conductors of opposite polarity. High current capacity terminals at each end of the cable, typically formed in halves insulated from each other, are provided for connection to the welding gun and current transformer. A key component in the manufacturing of kickless welding cables has been the terminals. Prior art terminals often have many components, some of which may be screwed or soldered in the manufacturing process. The fabrication of these individual parts adds to the parts cost of the terminal as well as increasing the time and expense to manufacture a complete cable. A primary point of failure of prior art welding cable is associated with the terminal and its connection to the cable.

Of interest is U.S. Pat. No. 4,199,653 issued Apr. 22, 1980 to L. M. Talley for "Termination for Alternate Polarity Resistance Welding Cable". The cable termination assembly described in this patent has multiple components which are basically designed to be fastened together such that the cable conductors at their terminal ends are substantially straight and parallel.

Also of interest is U.S. Pat. No. 4,018,976 issued Apr. 19, 1977 to E. I. Grove for "Kickless Resistance Welding Cable and Method of Making the Same". The conductors in this welding cable are terminated by end terminals, each of which include a pair of elongated semicylindrical copper terminal halves with an insulating strip in between. Each half terminal consists of a copper body, an adapter with pairs of bosses and an integral tongue member. The multiple component parts of this terminal unnecessarily increase the component cost as well as make assembly more time-consuming.

Of particular interest in U.S. Pat. No. 3,601,520 issued Aug. 24, 1971 to A. Carasso for "Terminal Structure for a Muticonductor Cable Cooled by a Circulating Fluid". The multiconductor terminal is in two parts separated by an insulating element. The plugged ends of the conductors are received within apertures provided at one end of each terminal half.

DISCLOSURE OF INVENTION

It is an object of the present invention to provide a simplified single part cable terminal which can be mechanically welded to a multiconductor kickless resistance welding cable in one step.

It is another object of the present invention to provide a simplified manufacturing process for attching the end terminals to a multiconductor kickless resistance welding cable. An integrally formed socket in the end of each half terminal receive all of the conductors of one polarity. The end of the terminal is crimped to mechanically weld the copper of the terminal with that of the conductors for providing good electrical conductivity. At the same time a passageway is formed from a cooling port on the terminal through the terminal body to the interior of the cable.

A particular advantage of the simplified water-cooled welding cable terminal according to the present invention is that the same casting can be used for a wide range of cable terminals thereby reducing manufacturing costs. The front end of the cable terminal, the portion that attaches to either the welding gun or the welding transformer, can change in length depending on the application. However, a casting for the simplified, single part cable terminal of the present invention can easily be machined to any desired length to accommodate the needs of a particular user.

Yet another feature of the simplified, single part cable terminal according to the present invention is that a versatile, yet simple casting is used for each terminal half. The cast terminal half has the advantage of higher conductivity compared to a comparable terminal half formed from a bar stock. In addition, the more malleable cast copper is "mechanically welded" to the copper of each electrical conductor in the manufacturing process for a high current carrying capacity.

BEST MODE FOR CARRYING OUT THE INVENTION

Figure 1:
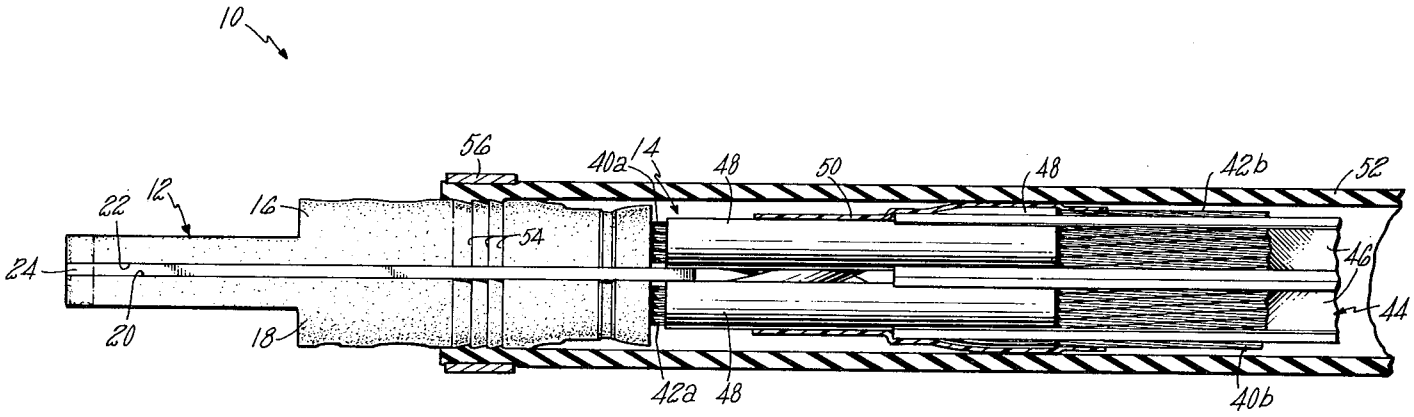
FIG. 1 is a side view of the simplified terminal for a water-cooled, high current welding cable according to the present invention, with both cutaway portions and sectional portions for clarity.

Referring now to FIG. 1, there is seen a simplified, water-cooled, kickless welding cable fabricated in accordance with the present invention. For purposes of clarity, the overall welding cable assembly has been generally designated by the reference numeral 10, while the terminal and the electrical conductors are designated as 12 and 14 respectively. Most often, a terminal 12 is employed at each end of the cable assembly 10 so that the entire assembly provides an electrical connection between a transformer (not shown) and a welding gun (not shown).

For the purposes of this description it should be understood that the term "front" as hereinafter applied to the description of the terminal 12 generally apply to the outward end thereof which is to be attached to either the transformer or the welding gun. The term "rear" refers to a direction generally inwardly of that end toward the attachment point for the electrical conductors 14.

Figure 2:
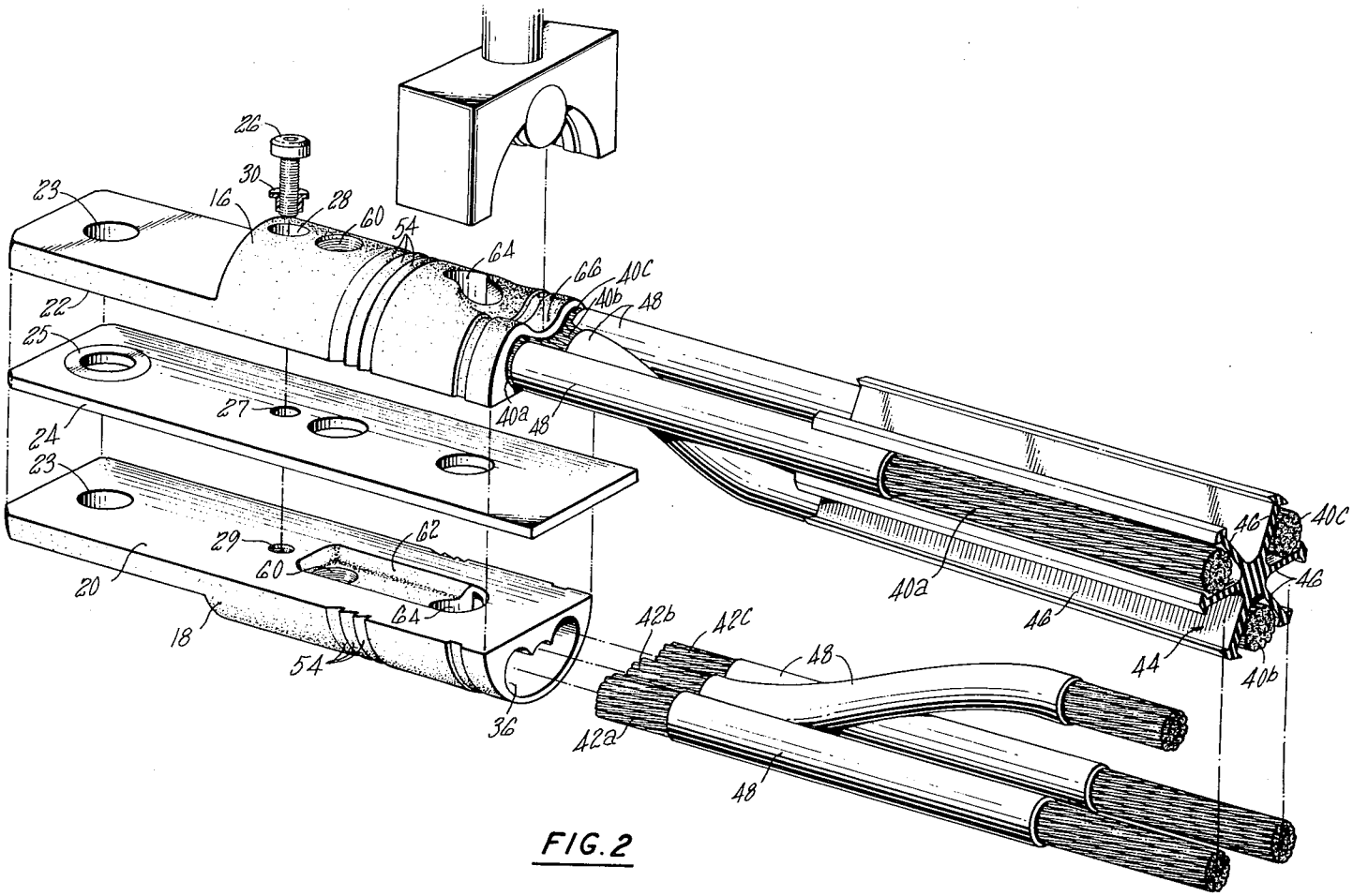
FIG. 2 is a perspective view showing the simplified cable terminal, in exploded form, according to the present invention as well as portions of the welding cable.

Each terminal 12 generally comprises a pair of semicylindrical, elongated half terminal 16 and 18 of essentially identical shape. Each half terminal 16 and 18 has an inner flat face 20 and 22 (FIG. 2), respectively, separated by an insulator 24 which is rectangularly shaped and fabricated from a material suitable to provide electrical isolation between the two halves. An aperture 23 through the terminal 12 is provided to connect each end of the cable 10. A ring 25, formed from a noncompressible insulating material, ensures that terminal half 16 and terminal half 18 are properly spaced apart. As is seen in FIG. 2, a screw 26 extends through an opening 28 in half terminal 16, an opening 27 in the insulator 24, into a threaded opening 29 in the half terminal 18, fixedly holding the two half terminals together. An insulating washer 30 electrically isolates the screw 26 from the half terminal 16.

The front of the terminal 12 is generally shaped to cooperate with the electrical connections on the transformer and the welding gun. Most often, this means a flat surface on the half terminal 16 and a similar flat surface on the half terminal 18, although other types of contact surfaces could be used. The aperture 23 extends through the terminal 12 allowing connection to a transformer output lug or a welding head lug by a conventional bolt, or the like. At the rear of each half terminal a socket 36 (FIG. 2) is provided in the end face for receiving the electrical conductors. Each socket 36 is formed by several axially-extending, overlapping bored openings which may be flaired at the end face to facilitate insertion of the electrical conductors.

As briefly mentioned before, kickless or low-reactant type resistance welding cable is generally known and extensively used because it is relatively immune to jerking or flexing when subjected to the extreme current surges that occur in the cable during the welding process. For the purpose of the present invention, it can be presumed that the welding cable 10 comprises six electrical conductors, three of which, 40*a*, 40*b* and 40*c* (FIG. 2) may be considered of one polarity while three electrical conductors 42*a*, 42*b* and 42*c* are of another polarity. The electrical conductors are circumferentially spaced about the cable such that the polarity of adjacent electrical conductors alternate. An elongated flexible core insulator 44 has a series of radially-extending ribs 46 thereon to electrically insulate the adjacent conductors. Each conductor also includes a sleeve 48 therearound, formed from a piece of insulating tubing which extends from approximately the end face of each terminal half to a point where it overlaps with the core insulator 44 to prevent electrical contact between conductors of opposite polarity near the rearward end of each half terminal 16 and 18. A section of heat shrink tubing 50 (FIG. 1) is provided for holding the individual sleeves 48 acting as a strain relief member over the life of the cable. A jacket 52 (FIG. 1) encloses the cable and extends the entire length of the cable to provide a flexible pipe for the coolant used to cool the welding cable in operation. A series of circumferentially-extending ribs 54 may be provided on each half terminal 16 and 18 so that clamp 56 (FIG. 1) may be utilized to form a seal between the interior sidewall of jacket 52 and the exterior surface of the half terminal.

A feature of the simplified welding cable terminal according to the present invention involves the passageway provided in the terminal 12 to allow the free flow of cooling water to cool the cable. This passageway is formed in the manufacturing process so that it includes no narrow apertures to restrict coolant flow. Each half terminal 16 and 18 includes a first port 60 (FIG. 2) which extends radially through the terminal body forwardly of the ribs 54. The sidewall of the first port 60 may be threaded to receive a nipple (not shown), which would in turn be attached to a source of coolant. An axially-extending passageway 62 (best seen in FIG. 2 on half terminal 18) is formed along the flat surfaces 20 and 22 of each half terminal 16 and 18, forming a passageway that communicates with the first port 60 and a second port 64 near the rearward end of each half terminal. In the manufacturing process, a chord-like, axially-extending depression 66 is formed at the rear of each terminal body from the second port 64 so that coolant can flow therealong to the interior of the cable.

A particularly important feature of the present invention involves the minimal number of manufacturing steps required to fabricate a kickless welding cable using the simplified terminal according to the present invention. Initially, six electrical conductors are cut to the desired length and a sleeve 48 is inserted over the end of each conductor. With the socket 36 at the rear of each terminal half, it is unnecessary to use lug elements or soldering of the electrical conductors to each half terminal. Next, the ends of outside electrical conductors are inserted into the socket 36, conductors 40*a* and 40*c* being seated against the end of the socket 36 while the end of conductor 40*b* extends into the socket only as far as the second port 64. Each half terminal with electrical conductors positioned as just described, is placed in a press containing special dye for crimping the rear portion of the terminal against the electrical conductors. It should be noted that the die includes a cylindrical pin with a raised ring attached thereto; this combination, under the pressure exerted by the press, essentially "mechanically welds" the electrical conductors to the sidewall of the socket 36.

In the next step of the manufacturing process, the half terminals 16 and 18 are placed adjacent to each other with the insulator 24 therebetween. The center electrical conductors 40*b* and 42*b* are aligned with the opposite half terminal, i.e., the central electrical conductor is positioned in the same plane with the outside conductors of the other half terminal. The sleeve 48 placed on each conductor is then pushed forward as far as it will go toward the rear of each half terminal. The sleeve 48 serves as an electrical insulator and also acts to resist bending stresses that typically occur immediately adjacent the cable terminal. The core insulator 44 is placed in position so that it overlaps the sleeve 48. A glue, or other settable type material not soluble in the coolant, is placed on all of the sleeves 48. A tube 50 (FIG. 1), preferably fabricated from a cylindrical section of heat shrinkable material, is placed over the conductor bundle. A sealant, coating the inner sidewall of the tube 50, adheres to the conductor bundle and bridges the gap from the end face of the terminal and the sleeves 48 on the individual conductors. A blower drive driven heat gun is then used to shrink the tube 50 against the conductor bundle and speed up the curing of the sealant. This prevents creep of both the sleeves 48 and the core insulator 44 over the life of the welding cable. Finally, the jacket 52 is then inserted over the conductor bundle with its end beyond the sealing grooves 54 (FIG. 1). A band 56 (FIG. 1) is placed over the jacket 52 and compressed to seal the jacket and the terminal 12.

Although this invention has been shown and described with respect to a preferred embodiment, it will be understood by those skilled in this art that various changes in form and detail thereof may be made without departing from the spirit and scope of the claimed invention.

I claim:

1. A dual polarity terminal for a cable having a plurality of electrical conductors and an internal passageway for receiving a cooling fluid comprising two half terminals each having a body which is shaped as an elongated half cylinder with a semicircular sidewall, a flat inner surface and an end face, an insulator sized to be positioned between said flat inner surfaces for providing electrical isolation between said two half terminals, each of said half terminals also including a socket integrally formed in said end face for receiving a plurality of electrical conductors of the same polarity, each of said half terminals also including a first port located near a mid-portion thereof and a second port located near a rear portion of the terminal, an axially-extending passageway formed in said flat inner surface of each of said half terminals communicating with said first and second port, each of said half terminals also including a depressed chordal section formed by mechanically welding said electrical conductors in said semicircular sidewall adjacent said socket which, in conjunction with said second port, said axially-extending passagway and said first port, form a passageway for allowing cooling fluid to flow through each of said half terminals to the internal passageway of said cable.

2. A dual polarity terminal according to claim 1, and a cable wherein one dual polarity terminal is fixedly attached to each end of said cable, and wherein the cable includes six electrical conductors extending between said dual polarity terminals, three of which are of positive polarity and three of which are of negative polarity.

3. A dual polarity terminal according to claim 2, wherein said six electrical conductors are circumferentially spaced about said cable in an alternate polarity configuration.

4. A dual polarity terminal according to claim 3, wherein each of said six electrical conductors has positioned thereover an insulating sleeve, the end of which overlaps with the end of a core insulator.

5. A dual polarity terminal according to claim 4, wherein said core insulator has six radially-extending ribs which form V-shaped slots for separating said electrical conductors.

6. A dual polarity terminal according to claim 5, wherein said three electrical conductors of said positive polarity are alternately positioned in said V-shaped slots of said core insulator with said three electrical conductors of said negative polarity.

7. A dual polarity terminal according to claim 6, wherein there are two outside conductors of each polarity aligned with corresponding V-shaped slots of said core insulator while a center electrical conductor of each polarity extends to the opposite half of said cable in line with said other half terminal.

8. A dual polarity terminal according to claim 1, wherein a half terminal defines a semicircular surface and wherein at least one circumferentially extending groove is formed in the semicircular surface of said half terminal.

9. A dual polarity terminal according to claim 8, and a cable wherein said cable further includes a jacket which is sealed against said dual polarity terminal by a band which compresses an end portion of a jacket against said at least one circumferentially extending groove.

* * * * *